US007217082B2

(12) United States Patent
Frampton et al.

(10) Patent No.: US 7,217,082 B2
(45) **Date of Patent: *May 15, 2007**

(54) ASYMETRICALLY BLADED CEILING FAN

(75) Inventors: Thomas C. Frampton, Zinonsville, IN (US); Peter S. Jenkins, Avon, IN (US)

(73) Assignee: Fanimation, Inc., Zionsville, IN (US)

( * ) Notice: Subject to any disclaimer, the term of this patent is extended or adjusted under 35 U.S.C. 154(b) by 21 days.

This patent is subject to a terminal disclaimer.

(21) Appl. No.: 10/752,972

(22) Filed: Jan. 7, 2004

(65) Prior Publication Data

US 2004/0141842 A1 Jul. 22, 2004

Related U.S. Application Data

(63) Continuation-in-part of application No. 10/041,375, filed on Jan. 8, 2002, now Pat. No. 6,726,451.

(51) Int. Cl.
*F04D 29/18* (2006.01)

(52) U.S. Cl. ..... 415/19; 415/5; 415/214 R

(58) Field of Classification Search ..... 416/5, 416/19, 144, 145, 214 R, 223 R, 241 B, 416/500

See application file for complete search history.

(56) References Cited

U.S. PATENT DOCUMENTS

| | | | |
|---|---|---|---|
| 2,079,044 | A | 5/1937 | Santmyer |
| 2,129,939 | A | 9/1938 | Juul |
| 2,837,301 | A | 6/1958 | Jenney |
| 3,693,910 | A | 9/1972 | Aldi |
| 4,132,360 | A | 1/1979 | Lee, Jr. |
| D306,643 | S | 3/1990 | Taylor, III |
| D309,183 | S | 7/1990 | Taylor, III |
| D313,467 | S | 1/1991 | Frampton |
| D325,436 | S | 4/1992 | Taylor, III |
| D325,778 | S | 4/1992 | Taylor, III |
| D326,149 | S | 5/1992 | Taylor, III |
| D329,285 | S | 9/1992 | Taylor, III |
| D329,286 | S | 9/1992 | Taylor, III |

(Continued)

FOREIGN PATENT DOCUMENTS

| | | | |
|---|---|---|---|
| AU | 133424 | A | 4/1998 |

(Continued)

OTHER PUBLICATIONS

Fanimation, "Unique Ceiling, Wall & Floor Mounted Fans," catalog, Jan. 1990, USA.

(Continued)

*Primary Examiner*—Richard A. Edgar
*Assistant Examiner*—Dwayne J White
(74) *Attorney, Agent, or Firm*—Maginot, Moore & Beck

(57) ABSTRACT

An asymmetrically bladed ceiling fan including a fan motor, a shaft rotatably connected to the motor and defining a vertical axis, a motor housing substantially enclosing the motor, a first fan blade extending from the housing, a second fan blade extending from the housing, and a first non-blade stabilizer extending from the housing for stabilizing the rotating weight of the fan blades upon actuation of the motor. The stabilizer is non-coincident with the first and second fan blades. The first and second fan blades are asymmetrically positioned relative the vertical axis.

46 Claims, 10 Drawing Sheets

U.S. PATENT DOCUMENTS

| | | | | |
|---|---|---|---|---|
| D329,896 | S | 9/1992 | Taylor, III | |
| D336,513 | S | 6/1993 | Junkin et al. | |
| D341,419 | S | 11/1993 | Taylor, III | |
| 5,439,352 | A | 8/1995 | Line | |
| 5,462,462 | A | 10/1995 | Woodley | |
| D424,190 | S | 5/2000 | Tang | |
| D432,640 | S | 10/2000 | Frampton | |
| D433,118 | S | 10/2000 | Frampton | |
| D433,119 | S | 10/2000 | Frampton | |
| D433,498 | S | 11/2000 | Frampton | |
| D433,747 | S | 11/2000 | Frampton | |
| D433,748 | S | 11/2000 | Frampton | |
| D433,749 | S | 11/2000 | Frampton | |
| D434,134 | S | 11/2000 | Frampton | |
| D437,047 | S | 1/2001 | Frampton | |
| D437,406 | S | 2/2001 | Frampton | |
| D438,610 | S | 3/2001 | Frampton | |
| D438,950 | S | 3/2001 | Frampton | |
| D443,926 | S | 6/2001 | Frampton | |
| D444,553 | S | 7/2001 | Frampton | |
| 6,309,083 | B1 | 10/2001 | Lathrop et al. | |
| D450,380 | S | 11/2001 | Frampton | |
| D451,997 | S | 12/2001 | Schwartz | |
| D454,192 | S | 3/2002 | Frampton | |
| D454,634 | S | 3/2002 | Frampton | |
| D454,635 | S | 3/2002 | Frampton | |
| 6,352,407 | B2 | 3/2002 | Hill et al. | |
| 6,428,188 | B1 | 8/2002 | Magno, Jr. et al. | |
| 6,726,451 | B2 * | 4/2004 | Frampton | 416/5 |

FOREIGN PATENT DOCUMENTS

| | | | |
|---|---|---|---|
| AU | 133424 | S | 4/1998 |

OTHER PUBLICATIONS

Clem Labine's Traditional Building, "A Fan-tastic Ceiling Accessory," magazine article, Nov./Dec. 1997, USA.

Architectural Antiques—Andy Thornton, "Fan Systems," catalog, No. 12, First Edition, Mar. 1994, USA.

Gumps Mail Interiors, Plantation Ceiling Fan, catalog, Jul. 1998, USA.

The Sharper Image Home Collection, Plantation Ceiling Fan, catalog, Summer 1998, USA.

American Homestyle & Gardening, "The Islander Fan," magazine article, Aug./Sep. 1995, USA.

Metropolitan Home, "Three-Leaf Palm Fan by Fanimation," magazine article, Jul./Aug. 1998, USA.

A-PLUS: Art/Antiques/Design—Cape Cod Edition, "Keep Your Cool," news article, Jun. 1998, USA.

Friedes Associates, "1997 Hudson River Showhouse, New York," promotional piece, specific date unknown, USA.

Photograph—author unknown, Dec. 3, 1995, Raffles Hotel, Singapore.

Photograph—author unknown, circa 1905, White Rabbit Saloon, Tennessee.

FANIMATION, "The Islander," promotional piece, date unknown, USA.

FANIMATION, "The Palisade," promotional piece, date unknown, USA.

Winnower Fan Co. Inc., advertising brochure, p. 20, Ceiling Fan A

Fanimation, "Unique Ceiling, Wall & Floor Mounted Fans," catalog, Jan. 2000, USA.

Emerson, "Ceiling Fans Research & Development" catalog, Jan. 2001, USA.

"Hampton Bay," promotional piece, date unknown, USA.

The Beacon, "Neon is a gas: local firm produces sisns, architectural lighting," Newspaper Article, Aug. 1998, USA.

NICOR advertisement, Sep. 2000 issue, USA.

NICOR website; www.nicorlighting.com, Jul. 5, 2002, various celing fan photographs.

Regency ceiling fans, "Tropic Air," promotional piece brochure, Copyright 2001, USA.

Furniture Style, "Tahitian Ceiling Fan," magazine article, Concord product advertisement, Dec. 2001.

Home Lighting & Accessories, Vintage Crown Collection, magazine article, Concord product advertisement, Dec. 2001.

Fanimation, "Unique Ceiling, Wall & Floor Fans," catalog, Jan. 2002, USA.

House, Kurt; *Antique Mechanical Fans;* Three Rivers Publishing Company; ©1983; (3 pages including p. 31).

* cited by examiner

ASYMETRICALLY BLADED CEILING FAN

CROSS-REFERENCE TO RELATED APPLICATIONS

This application is a continuation-in-part of U.S. patent application Ser. No. 10/041375, filed Jan. 8, 2002, now U.S. patent application Ser. No. 6,726,451.

TECHNICAL FIELD OF THE INVENTION

This invention relates to a ceiling fan and a ceiling fan blade mounting arrangement that produces a center of rotational gravity that lies outside the vertical axis of the rotating fan.

BACKGROUND OF THE INVENTION

There are two methods of mounting blades to a ceiling fan so that the rotating weight of the fan is stabilized and the fan's center of rotational gravity lies within its vertical axis: (1) An even number of blades are mounted directly across from each other so the rotating weight of one blade is stabilized and matched by its complement; and (2) an even or odd number of blades may be "offset" so the sum of the blades' rotating weight is balanced. In each case, prior ceiling fans have more than one blade arranged in the circle of rotation so that the center of rotational gravity of the fan lies within the vertical axis. Thus, upon rotation, a single bladed ceiling fan generates a center of rotational gravity that lies outside the fan's vertical axis. Such an arrangement is perceived as non-functional and unconventional.

Likewise, a ceiling fan blade mounting arrangement where the blades are not spaced equally around the fan's housing so as to produce a center of rotational gravity that lies outside the vertical axis of the rotating fan is unconventional as well. The present invention addresses this need.

SUMMARY OF THE INVENTION

The present invention relates to a ceiling fan blade mounting arrangement that produces a center of rotational gravity that lies outside the vertical axis of the rotating fan compensated by a stabilizing member. One object of the present invention is to provide an improved ceiling fan. Related objects and advantages will be apparent from the following description.

DESCRIPTION OF THE PREFERRED EMBODIMENT

Figure 1:
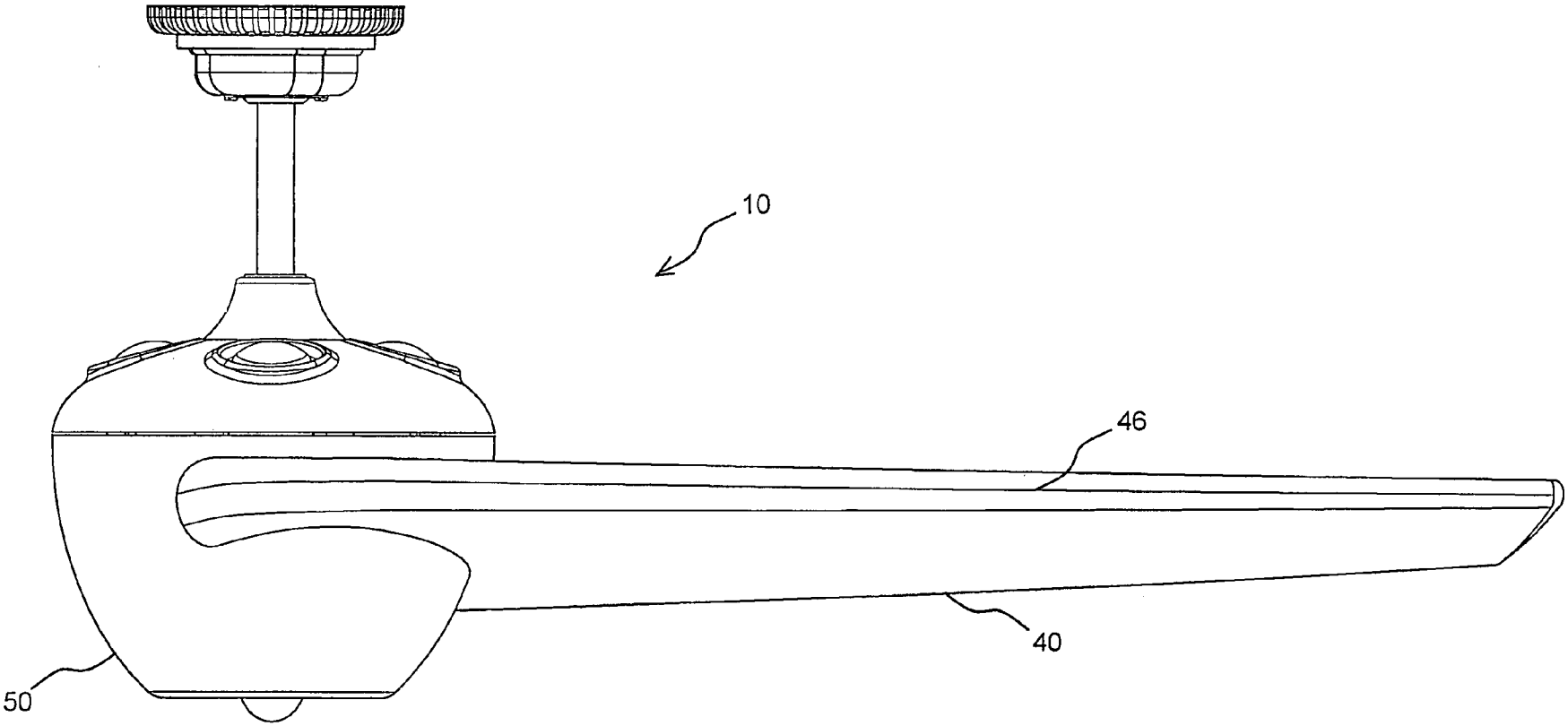
FIG. 1 is a perspective view of a single bladed ceiling fan of the invention.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Figure 2:
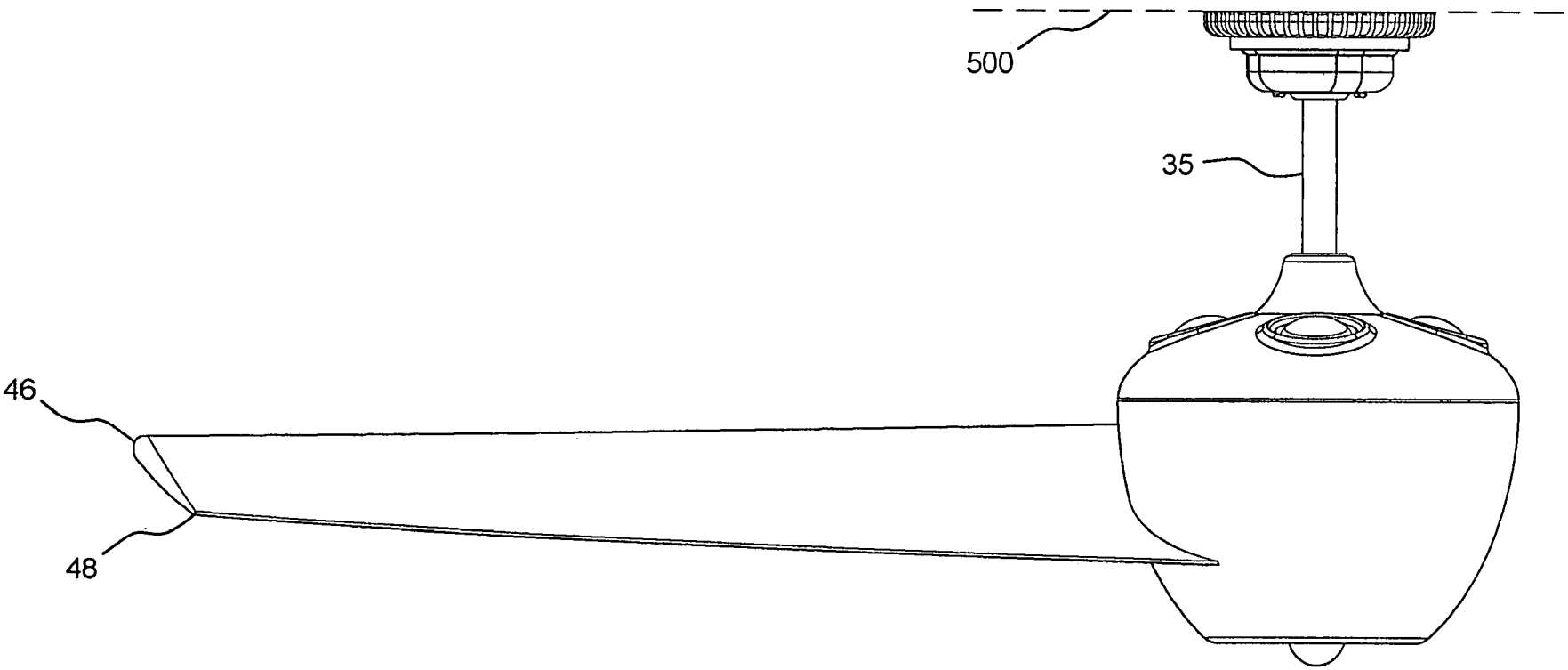
FIG. 2 is another view of the single bladed ceiling fan of FIG. 1.
Figure 3:
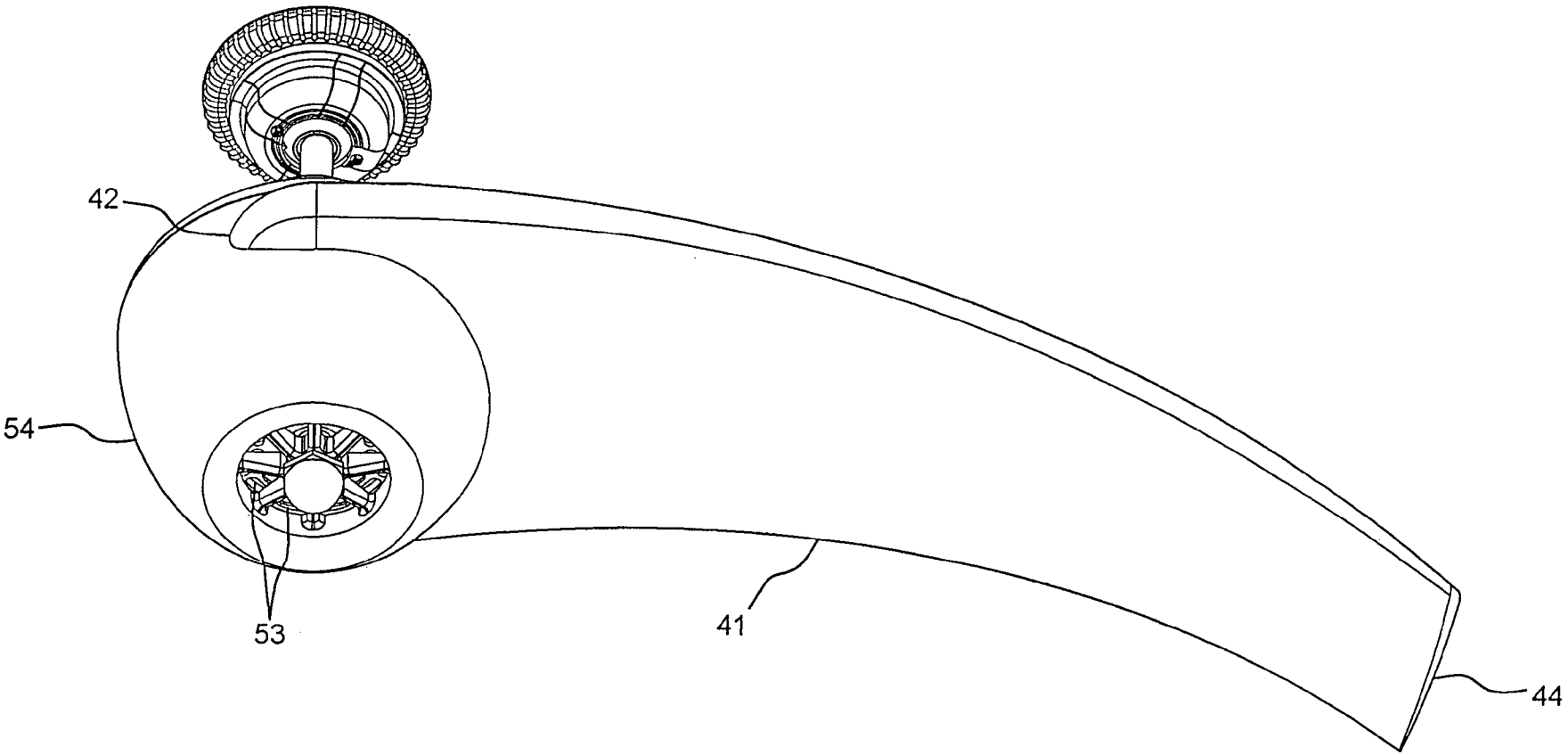
FIG. 3 is an elevated perspective view of another single bladed ceiling fan of the invention showing the arcuate body of the fan blade.

Ceiling fan blade arrangements according to the present invention are shown in FIGS. 1–9, wherein like elements are identified by like numerals. With reference to FIGS. 1–3, one preferred embodiment of the invention comprises a fan 10 including a single blade 40 extending radially from a central motor housing 50. Blade 40 may be connected to the fan directly or indirectly with extension hardware known in the art. Blade 40 can be formed from wood, wicker, plastic or organic matter, such as palm leaves, for example, which materials are known in the art. Of course, materials that have mechanical and physical properties rendering them better suited for the ceiling fans of the invention are preferred. Plastic, wood, metal and such rigid materials are more preferred.

In one embodiment, blade 40 has an elongated arcuate body 41 that tapers from a proximal end 42 to its opposing distal end 44. In an embodiment, blade 40 has a cross-section that progressively tapers from a leading edge 46 to a trailing edge 48. Such a fan would experience out-of-concentric rotation if not provided with some element to equal the balance of the fan or if the fan was not securely anchored in the ceiling at 500 via down rod 35, as shown in FIG. 2.

Figure 4:
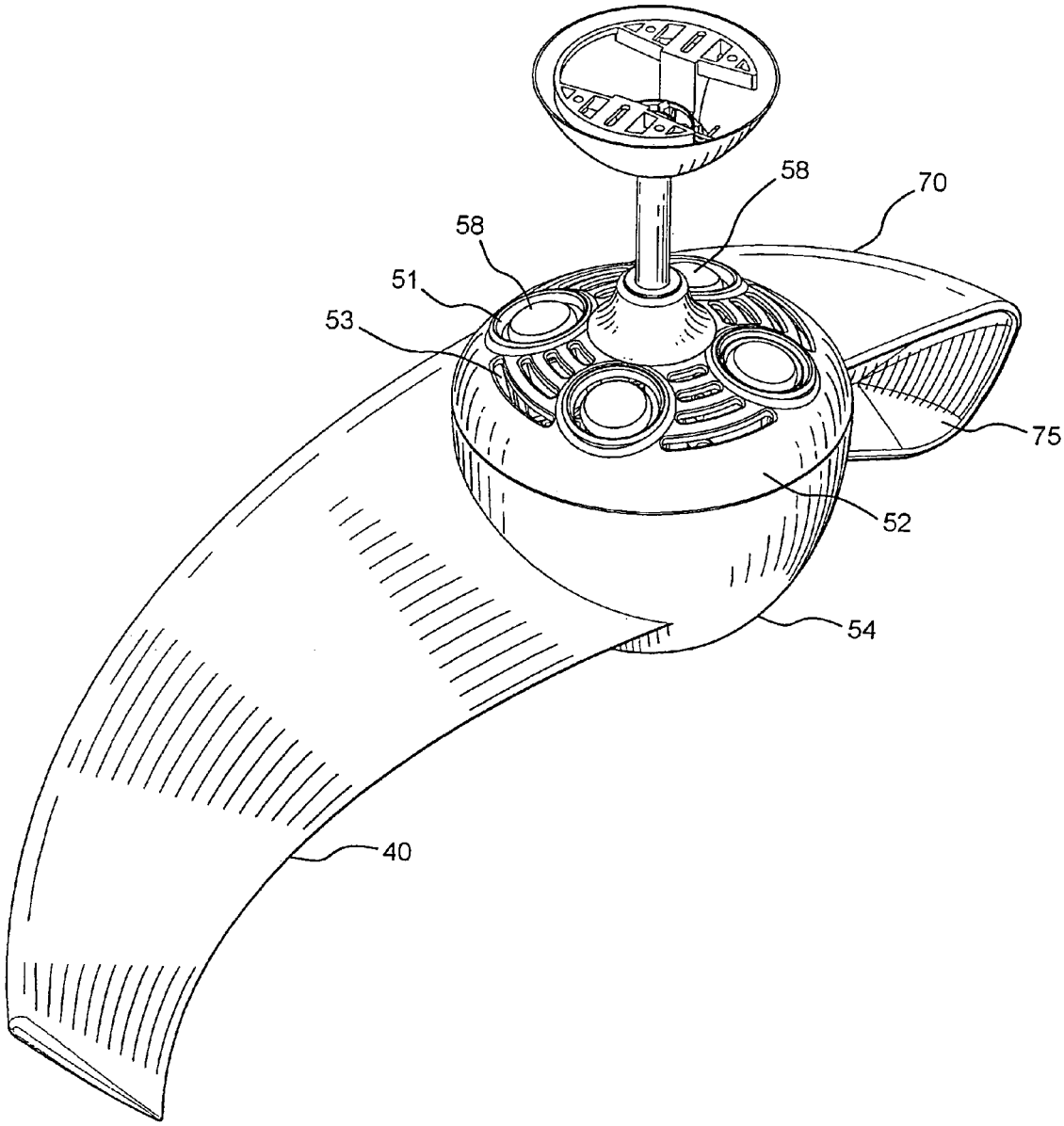
FIG. 4 is an elevated perspective view of still another single bladed ceiling fan of the invention showing the stabilizing member.
Figure 5:
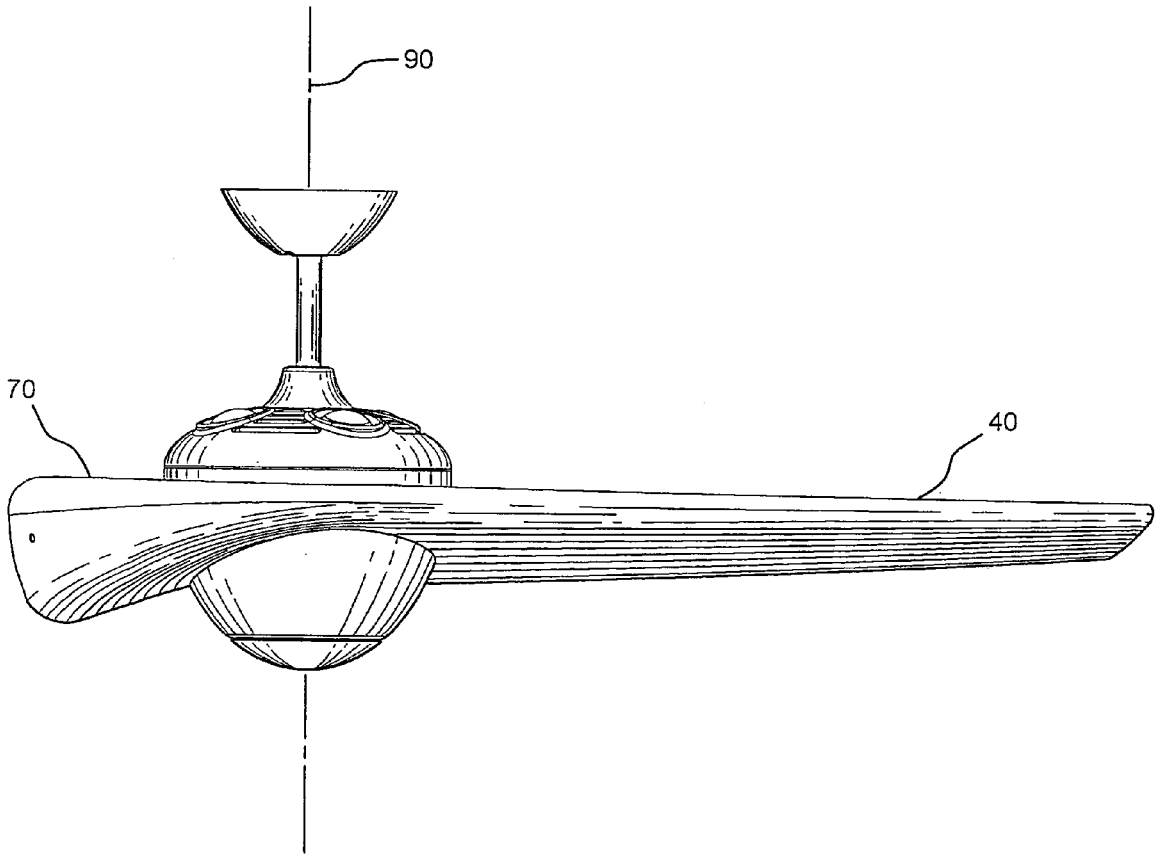
FIG. 5 is another view of the single bladed fan of FIG. 4.
Figure 6:
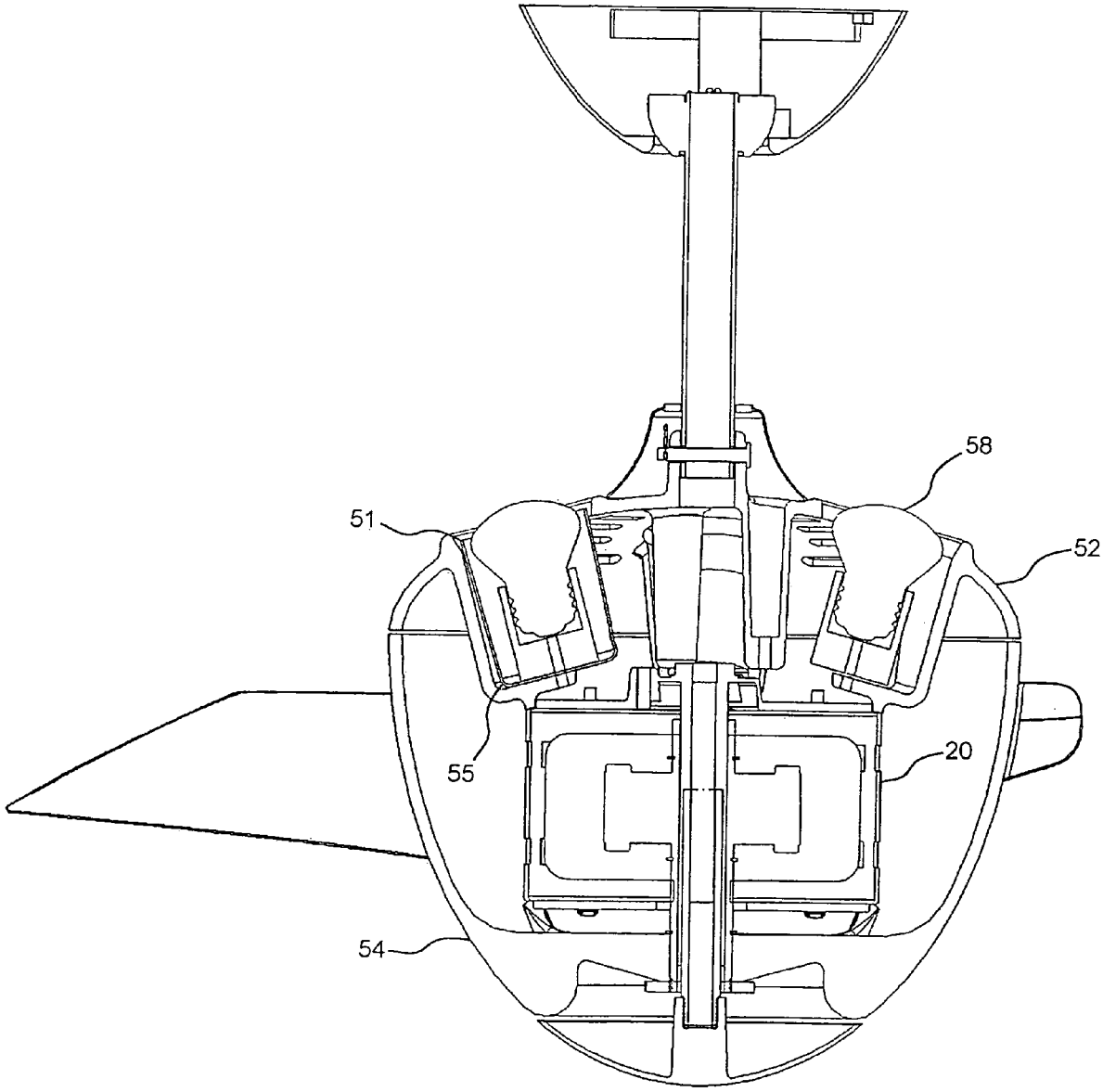
FIG. 6 is a cross-sectional perspective view of the upper and lower casings of the housing showing the bore, light bulb socket and light bulb contained in the housing.

In another preferred embodiment shown in FIGS. 4–6, a stabilizing member 70 is provided adjacent to the motor housing 50 opposite the single blade 40. As shown in FIG. 5, stabilizing member or stabilizer 70 has a thickness considerably greater than that of the opposing blade 40. Stabalizing member 70 is preferably configured as a non-blade stabilizer. In other words, the stabilizer preferably does not have the shape of a blade and/or perform the function of a blade. Stabilizing member 70 preferably performs two functions: (1) it stabilizes the rotating weight of the fan such that its center of rotational gravity lies within the vertical axis 90 of the fan; and (2) it equalizes the air or wind resistance or "drag" of blade 40. The greater thickness of stabilizing member 70 addresses the first concern, while opening 75 provides drag that approximates that generated by opposing blade 40. If desired, opening 75 may be enlarged or modified to form a partial air tunnel or "scoop" (not shown) in stabilizing member 70 to catch and direct air to and through the motor housing 50 to assist in cooling the electric drive motor during operation. Cover 80 is provided to cover opening 75, which provides the options of engaging other aeronautic variables that may be desirable.

Motor housing 50 can be provided with air ducts 53 in its upper casing 52 and/or lower casing 54, as shown in FIGS. 3 and 4. Air ducts 53 help cool motor 20, which contributes to prolonged life of the fan motor. With reference to FIG. 6, upper casing 52 includes bores 51 for accommodating light bulb socket 55 in which resides light bulb 58. Light bulb(s) 58 provide illumination upwardly through bore 51.

Figure 7:
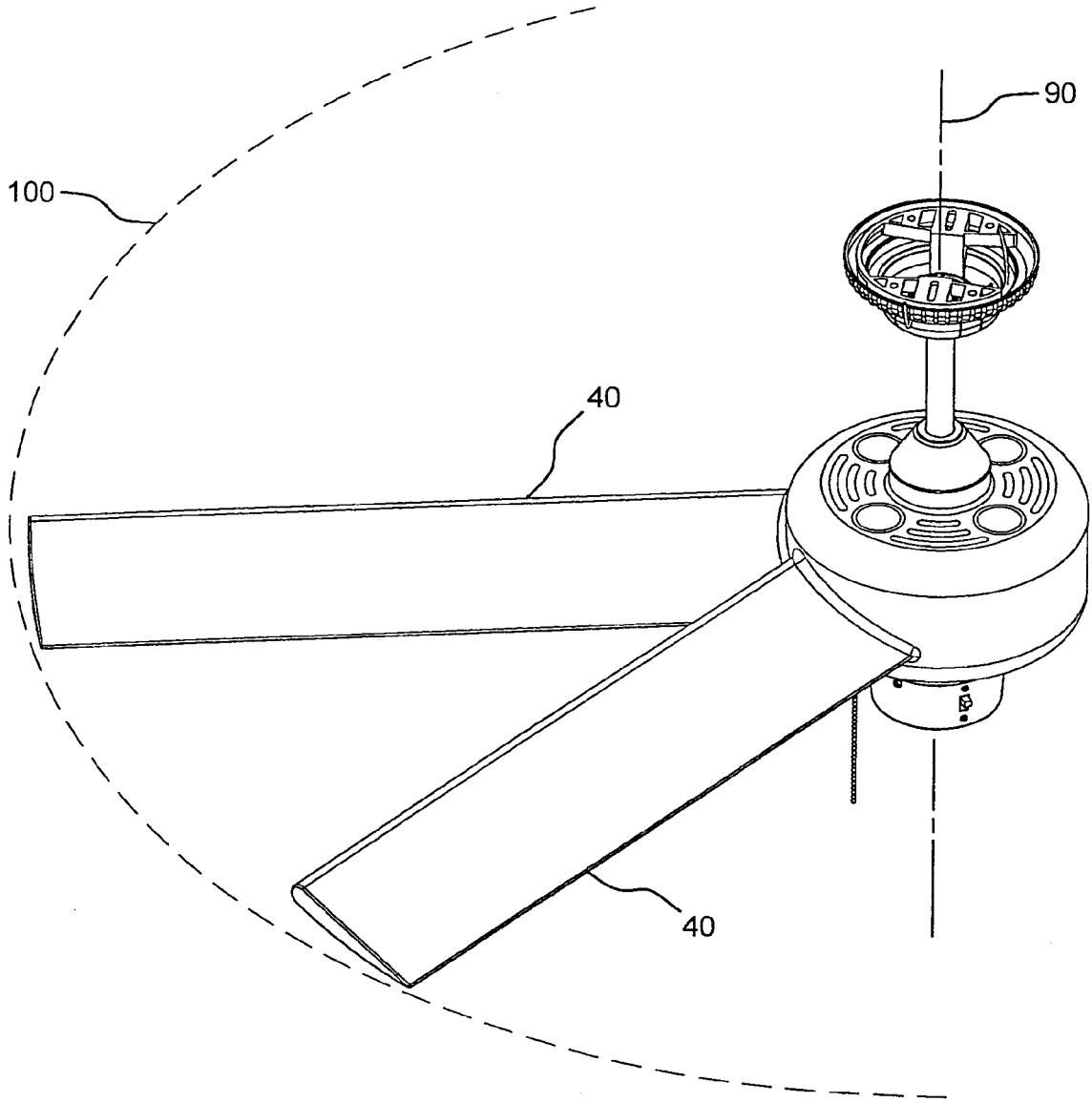
FIG. 7 is an elevated perspective view showing a ceiling fan blade mounting arrangement of the invention.
Figure 8:
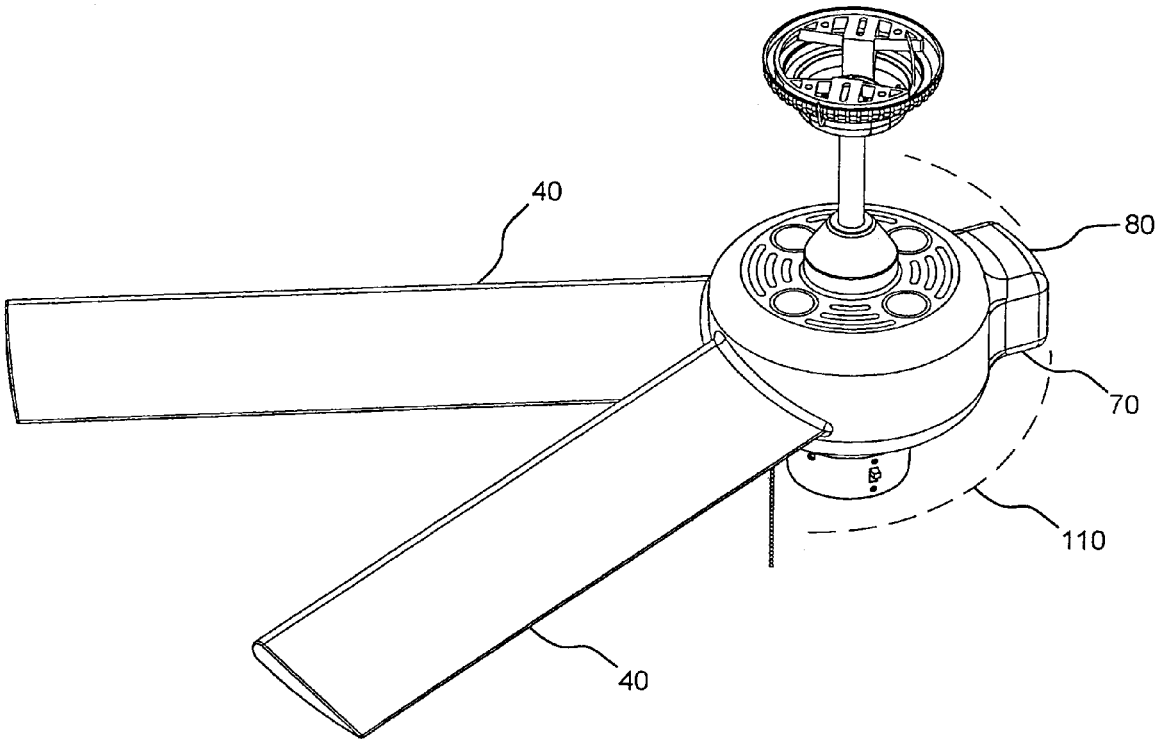
FIG. 8 is an elevated perspective view showing another fan blade mounting arrangement of the invention showing the stabilizing member and cover.
Figure 9:
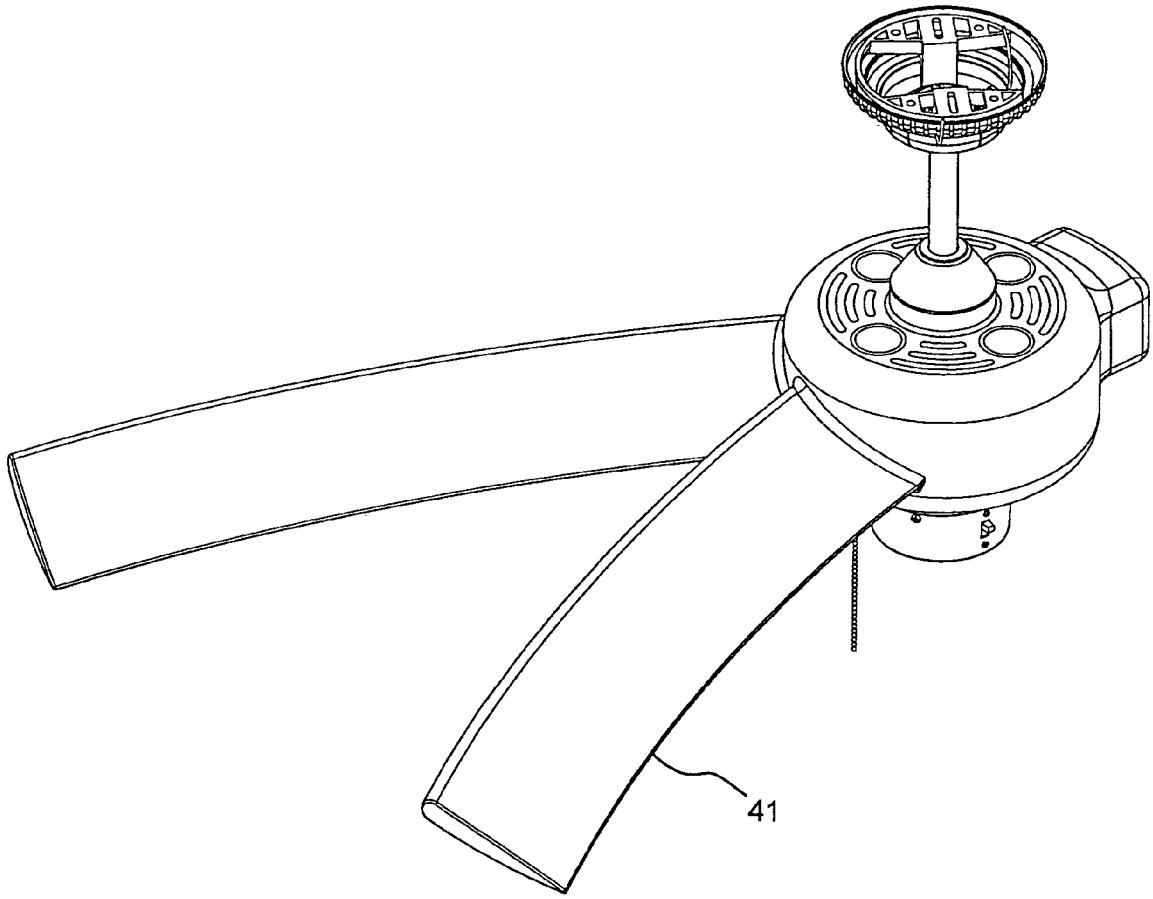
FIG. 9 is an elevated perspective view showing another blade mounting arrangement illustrating the arcuate body of the fan blade, the stabilizing member and cover.

With respect to FIGS. 7–9, in yet a further embodiment, fan 10 includes at least two fan blades 40 connected for rotation, arranged adjacent to each other in one semicircle of rotation 100. Stabilizing member 70 extends from fan 10 in a second semicircle of rotation 110 so that stabilizing member 70 stabilizes the rotating weight of the blades 40 on rotation so that the center of rotational gravity of the fan lies on longitudinal axis 90.

Figure 10:
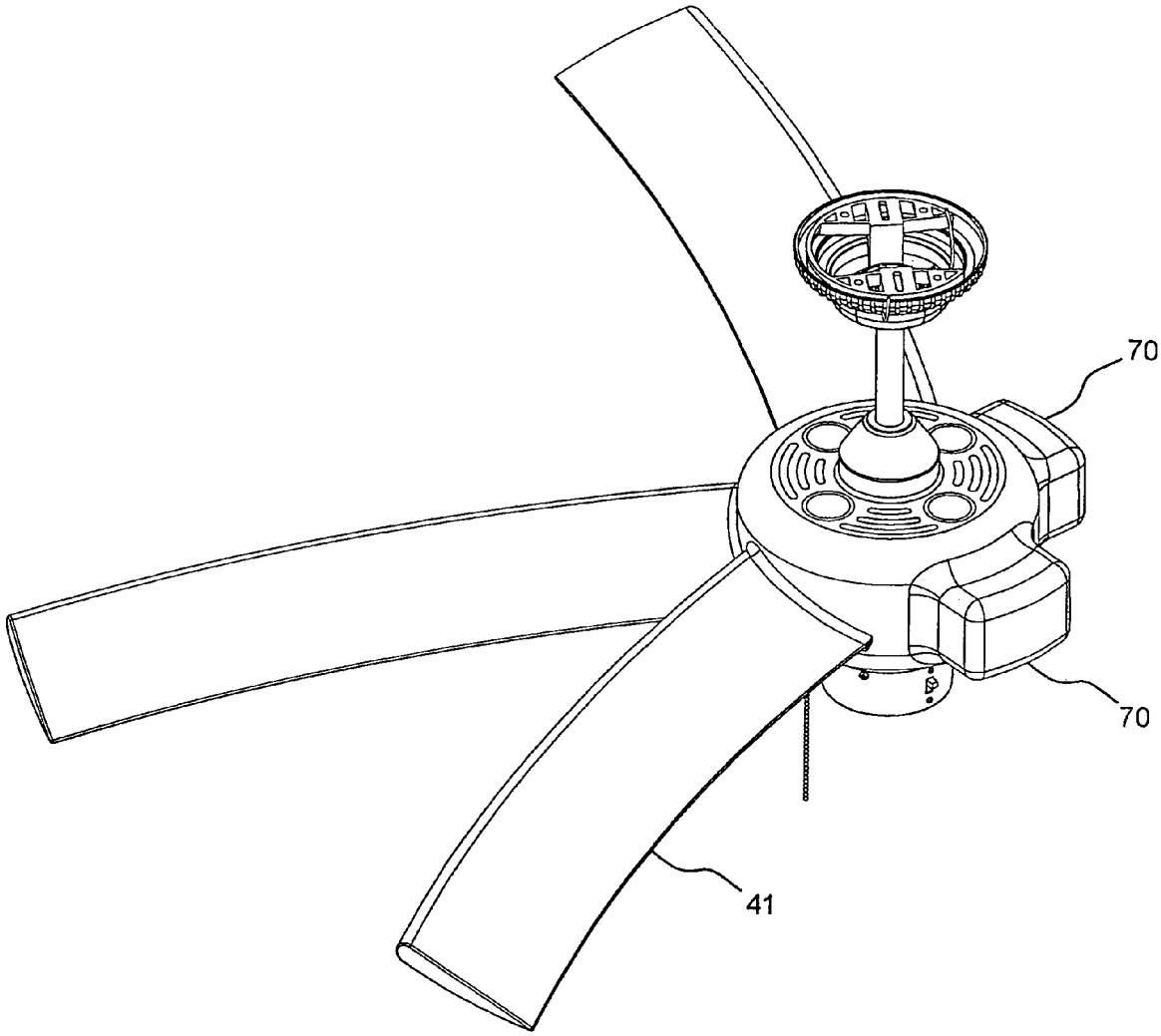
FIG. 10 is an elevated perspective view showing another blade mounting arrangement illustrating the stabilizing members arranged about and between the multiple blades.

Yet another contemplated embodiment includes two or more blades 40 spaced at various asymmetric and/or non-opposing positions in a radial fashion about the motor housing 50 and relative to the vertical axis 90. The blades 40 may be identical in shape and mass, or may each have a different shape and/or mass. Accordingly, such a fan might include one or more stabilizing members 70 arranged about and/or between or among the multiple blades so long as the center of rotational gravity lies on the vertical axis 90 of fan 10, as shown in FIG. 10.

Alternatively, if the multi-bladed fan of this invention is sufficiently anchored at the ceiling portion 500 and the downrod 35 is of sufficient strength, fan 10 need not have stabilizing member 70 and should withstand the torque and out-of-concentric forces generated by the rotation of a single blade 40 or two or more non-opposing blades.

Although the ceiling fan and mounting arrangement provided by the present invention have been described with a preferred embodiment, those skilled in the art will understand that modifications, variations and combinations may be made without departing from the scope of this invention as set forth in the following claims. Such modifications, variations, and combinations are considered to be within the purview and scope of the appended Claims. For example, the fan blade arrangement of FIG. 4 could be modified to include cover 80 for covering opening 75, and bores 51 that accommodate light bulbs 58 could be omitted. Likewise, stabilizing member(s) 70 can be altered or omitted accordingly. The blade arrangements of FIGS. 4, 8, and 9 may differ from each other so long as the rotating weight of fan 10 is stabilized and the fan's center of rotational gravity lies within the fan's vertical axis 90. As noted however, alternatively, if the fan of this invention is sufficiently anchored at the ceiling portion 500 and the downrod 35 is of sufficient strength, fan 10 need not have stabilizing member 70 and should withstand the torque and out-of-concentric forces generated by the rotation of a single blade 40 or two or more non-opposing blades, as shown in FIGS. 1, 2, 3, 6 and 7.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A fan assembly, comprising:

a motor;

a motor housing defining an interior space, said motor being positioned within said interior space; and a fan blade having a first end portion being positioned in direct contact with a portion of said motor housing;

a stabilizer extending from said motor housing and configured to stabilize the rotating weight of the blade upon rotation of the fan;

wherein said stabilizer extends from the fan blade and is positioned in direct contact with said motor housing, and wherein said motor is operable to rotate in unison (i) said portion of said motor housing, (ii) said fan blade, and (iii) said stabilizer.

2. The fan assembly of claim 1 wherein the fan blade is positioned in direct contact with an outer surface of the motor housing.

3. The fan assembly of claim 1 wherein the blade further comprises:

an elongated arcuate body having a hollow end with an opening; and a blade end positioned opposite the hollow end.

4. The fan assembly of claim 3 wherein the hollow end of the elongate arcuate body extends from generally opposing sides of the motor housing.

5. The fan assembly of claim 3 further comprising a cover configured to cover the opening.

6. The fan assembly of claim 4 wherein the fan blade has a leading edge and a trailing edge, and wherein the fan blade progressively tapers from the leading edge to the trailing edge.

7. The fan assembly of claim 5 wherein the fan blade has a leading edge and a trailing edge, and wherein the fan blade progressively tapers from the leading edge to the trailing edge.

8. A blade mounting arrangement for a ceiling fan of the type that includes a downrod for supporting the fan from the ceiling, a motor, a motor housing in which the motor is positioned, a shaft coupled to the motor for turning the shaft about the shaft's longitudinal axis, and fan blades mounted for rotation to the fan at spaced positions circumscribing the shaft, wherein, upon rotation, the blades define a circle of rotation, and the fan achieves a center of rotational gravity that lies on the shaft's longitudinal axis as a result, the blade mounting arrangement comprising:

a first fan blade directly attached to said motor housing and extending in one semicircle of rotation, wherein upon rotation of the first fan blade, a center of rotational gravity is produced which lies outside the shaft's longitudinal axis.

9. The blade mounting arrangement of claim 8 further comprising a stabilizing structure extending from the motor housing, wherein the stabilizing structure stabilizes the rotating weight of the first fan blade upon rotation of the fan blade and stabilizing structure such that the center of rotational gravity of the fan blade and stabilizing structure is coincident with the longitudinal axis of the shaft.

10. The blade mounting arrangement of claim 9 further comprising a second fan blade directly attached to said motor housing and arranged in the one semicircle of rotation, wherein the stabilizing structure stabilizes the rotating weight of the first and the second fan blades upon rotation of the first fan blade, the second fan blade, and the stabilizing structure such that the center of rotational gravity of the first fan blade, the second fan blade, and the stabilizing structure is coincident with the longitudinal axis of the shaft.

11. The blade mounting arrangement of claim 9 further comprising a plurality of fan blades directly attached to the motor housing and extending from the motor housing in the one semicircle of rotation, wherein the stabilizing structure stabilizes the rotating weight of the plurality of fan blades upon rotation of the first fan blade, the stabilizing structure, and the plurality of fan blades such that the center of rotational gravity of the first fan blade, the stabilizing structure, and the plurality of fan blades lies on the longitudinal axis of the shaft.

12. The blade mounting arrangement of claim 8 wherein the motor housing has an upper casing and a lower casing, and wherein the lower casing is free to rotate about the longitudinal axis relative to the upper casing.

13. The blade mounting arrangement of claim 10 wherein the stabilizing structure includes first and second stabilizing components extending from the motor housing, said first and second stabilizing components being spaced apart from each other, wherein the first and second stabilizing components stabilize the rotating weight of the first and second fan blades upon rotation of the first fan blade, the second fan blade, and the stabilizing structure such that the center of rotational gravity of the first fan blade, the second fan blade, and the stabilizing structure lies on the longitudinal axis of the shaft.

14. The blade mounting arrangement of claim 12 wherein the upper casing has an air duct formed therein.

15. The blade mounting arrangement of claim 12 wherein the lower casing has an air duct formed therein.

16. The blade mounting arrangement of claim 14 further comprising at least one bore extending through the exterior surface of the upper casing for accommodating a light bulb socket in which resides a light bulb, wherein the light bulb is contained substantially within the housing and provides illumination upwardly through the bore.

17. The blade mounting arrangement of claim 15 further comprising at least one bore extending through the exterior surface of the upper casing for accommodating a light bulb socket in which resides a light bulb, wherein the light bulb is contained substantially within the housing and provides illumination upwardly through the bore.

18. A fan assembly, comprising:

a motor;

a motor housing defining an interior space, said motor being positioned within said interior space; and a fan blade having a first end portion being positioned in direct contact with a portion of said motor housing;

wherein said motor is operable to rotate in a recirculating path of movement both (i) said portion of said motor housing, and (ii) said fan blade; and wherein the blade further comprises an elongated arcuate body that tapers from one end to its other end.

19. A fan assembly, comprising:

a motor;

a motor housing defining an interior space, said motor being positioned within said interior space; and a fan blade having a first end portion being positioned in direct contact with a portion of the housing;

wherein said motor is operable to rotate in a recirculating path of movement both (i) the portion of the motor housing, and (ii) said fan blade, and wherein the fan blade has a cross-section that progressively tapers from a leading edge to a trailing edge.

20. The fan assembly of claim 19 wherein the fan blade is configured as an elongated arcuate body that tapers from one end to its other end.

21. A fan assembly, comprising:

a motor;

a motor housing having an upper casing and a lower casing, said motor housing defining an interior space, and said motor being positioned within said interior space; and a fan blade having a first end portion that is positioned in direct contact with said lower casing of said motor housing;

wherein said motor is operable to rotate in unison (i) the lower casing of the motor housing, and (ii) the fan blade.

22. The fan assembly of claim 21 wherein the fan blade is configured as an elongated arcuate body that tapers from one end to its other end.

23. The fan assembly of claim 22 wherein the upper casing has an air duct formed therein.

24. The fan assembly of claim 22 wherein the lower casing has an air duct formed therein.

25. The fan assembly of claim 23 further comprising at least one bore extending through an exterior surface of the upper casing for accommodating a light bulb socket in which resides a light bulb, wherein the light bulb is contained substantially within the housing and provides illumination upwardly through the bore.

26. The fan assembly of claim 24 further comprising at least one bore extending through an exterior surface of the upper casing for accommodating a light bulb socket in which resides a light bulb, wherein the light bulb is contained substantially within the housing and provides illumination upwardly through the bore.

27. The fan assembly of claim 26 wherein the upper casing has an air duct formed therein.

28. A blade mounting arrangement for a ceiling fan having a downrod for supporting the fan from the ceiling, a motor, a shaft connected to the motor and defining a longitudinal axis, a motor housing in which the motor is positioned, and fan blades mounted for rotation to the fan at spaced positions circumscribing the shaft, wherein, upon rotation, the blades define a circle of rotation, and the fan achieves a center of rotational gravity that lies on the shaft's longitudinal axis as a result, the blade mounting arrangement comprising:

at least two fan blades each being directly attached to the motor housing and extending in one semicircle of rotation;

a stabilizing member extending from the fan in a second semicircle of rotation relative to the at least two fan blades;

wherein the stabilizing member stabilizes the rotating weight of the blades upon rotation of the fan such that the center of rotational gravity of the fan lies on the longitudinal axis of the shaft; and wherein the at least two fan blades further comprise an elongated arcuate body that tapers from one end to the other.

29. The blade mounting arrangement of claim 28 wherein each of the at least two fan blades has a cross-section that progressively tapers from a leading edge to a trailing edge.

30. The blade mounting arrangement of claim 28, wherein the housing has an upper casing and a lower casing, and wherein the lower casing is free to rotate about the longitudinal axis relative to the upper casing.

31. The blade mounting arrangement of claim 29 wherein each of the at least two blades is configured as an elongated arcuate body that tapers from one end to its other end.

32. The blade mounting arrangement of claim 30 wherein each of the at least two blades is configured as an elongated arcuate body that tapers from one end to its other end.

33. The blade mounting arrangement of claim 32 wherein the upper casing has an air duct formed therein.

34. The blade mounting arrangement of claim 32 wherein the lower casing has an air duct formed therein.

35. The blade mounting arrangement of claim 33 further comprising at least one bore extending through an exterior surface of the upper casing for accommodating a light bulb socket in which resides a light bulb, wherein the light bulb is contained substantially within the housing and provides illumination upwardly through the bore.

36. The blade mounting arrangement of claim 34 further comprising at least one bore extending through an exterior surface of the upper casing for accommodating a light bulb socket in which resides a light bulb, wherein the light bulb is contained substantially within the housing and provides illumination upwardly through the bore.

37. The blade mounting arrangement of claim 36 wherein the upper casing has an air duct formed therein.

38. A blade mounting arrangement for a ceiling fan having a motor, a shaft rotatably connected to the motor and defining a longitudinal axis, a motor housing in which the motor is positioned, and fan blades mounted for rotation to the fan at spaced positions circumscribing the shaft, wherein, upon rotation, the blades define a circle of rotation, and the fan achieves a center of rotational gravity that lies on the shaft's longitudinal axis as a result, the blade mounting arrangement comprising:

at least two fan blades each being directly connected to the motor housing and extending in one semicircle of rotation;

a stabilizing member extending from the fan in a second semicircle of rotation relative to the at least two fan blades, wherein the stabilizing member stabilizes the rotating weight of the blades upon rotation of the fan such that the center of rotational gravity of the fan lies on the longitudinal axis of the shaft; and, the at least two fan blades having a cross-section that progressively tapers from a leading edge to a trailing edge.

39. A blade mounting arrangement for a ceiling fan of the type that typically includes a downrod for supporting the fan from the ceiling, a motor, a shaft rotatably connected to the motor so that the motor can turn the shaft about the shaft's longitudinal axis, a motor housing supported by the shaft, and fan blades mounted for rotation to the fan at spaced positions circumscribing the shaft, wherein, upon rotation, the blades define a circle of rotation, and the fan achieves a center of rotational gravity that lies on the shaft's longitudinal axis as a result, the blade mounting arrangement comprising:

at least two fan blades asymmetrically connected for rotation to the fan and extending in one semicircle of rotation;

a stabilizing member extending from the fan in a second semicircle of rotation relative to the at least two fan blades, wherein the stabilizing member stabilizes the rotating weight of the blades upon rotation of the fan such that the center of rotational gravity of the fan lies on the longitudinal axis of the shaft; and, a motor housing supported by the shaft, the housing having an upper casing and a lower casing, wherein the lower casing is free to rotate about the longitudinal axis relative to said upper casing.

40. A single bladed ceiling fan comprising:

a fan motor;

a shaft rotatably connected to the motor;

a motor housing substantially enclosing the motor;

a single fan blade extending from the housing; and a non-blade stabilizer extending from the housing;

wherein the non-blade stabilizer stabilizes the rotating weight of the single fan blade upon actuation of the motor.

41. The single bladed ceiling fan of claim 40, wherein the non-blade stabilizer depends from the fan blade.

42. An asymmetrically bladed ceiling fan comprising:

a fan motor;

a shaft rotatably connected to the motor and defining a vertical axis;

a motor housing substantially enclosing the motor;

a first fan blade extending from the housing;

a second fan blade extending from the housing;

a first non-blade stabilizer extending from the housing for stabilizing the rotating weight of the fan blades upon actuation of the motor;

wherein the stabilizer is non-coincident with the first fan blade;

wherein the stabilizer is non-coincident with the second fan blade; and wherein the first and second fan blades are asymmetrically positioned relative to the vertical axis.

43. The asymmetrically bladed ceiling fan of claim 42 further comprising a second non-bladed stabilizer extending from the housing.

44. An asymmetrically bladed ceiling fan comprising:

a fan motor;

a shaft rotatably connected to the motor and defining a vertical axis;

a motor housing substantially enclosing the motor;

a first fan blade extending from the housing;

a second fan blade extending from the housing; and a first non-blade stabilizer extending from the housing;

wherein the fan motor is spaced from the ceiling; and wherein the first and second blades intersect nonlinearly.

45. The asymmetrically bladed ceiling fan of claim 44 wherein the stabilizer is non-coincident with the first fan blade and wherein the stabilizer is non-coincident with the second fan blade.

46. The asymmetrically bladed ceiling fan of claim 45 wherein the first non-blade stabilizer stabilizes the rotating weight of the fan blades upon actuation of the motor.

* * * * *